US009523043B2

(12) United States Patent
O'Rear et al.

(10) Patent No.: US 9,523,043 B2
(45) Date of Patent: Dec. 20, 2016

(54) PROCESS, METHOD, AND SYSTEM FOR REMOVING HEAVY METALS FROM FLUIDS

(71) Applicants: Dennis John O'Rear, Petaluma, CA (US); Russell Evan Cooper, Martinez, CA (US)

(72) Inventors: Dennis John O'Rear, Petaluma, CA (US); Russell Evan Cooper, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 109 days.

(21) Appl. No.: 14/481,265

(22) Filed: Sep. 9, 2014

(65) Prior Publication Data

US 2015/0076035 A1 Mar. 19, 2015

Related U.S. Application Data

(60) Provisional application No. 61/878,071, filed on Sep. 16, 2013.

(51) Int. Cl.

| | |
|---|---|
| ***C10G 7/00*** | (2006.01) |
| ***C10G 29/02*** | (2006.01) |
| ***C10G 29/10*** | (2006.01) |
| ***C10G 29/28*** | (2006.01) |

(52) U.S. Cl.

CPC ..... *C10G 29/02* (2013.01); *C10G 7/00* (2013.01); *C10G 29/10* (2013.01); *C10G 29/28* (2013.01); *C10G 2300/205* (2013.01); *C10G 2300/206* (2013.01)

(58) Field of Classification Search

CPC ..... C10G 7/00; C10G 29/02

See application file for complete search history.

(56) References Cited

U.S. PATENT DOCUMENTS

| | | | | |
|---|---|---|---|---|
| 4,474,896 | A * | 10/1984 | Chao | B01J 20/00 210/660 |
| 5,062,948 | A | 11/1991 | Kawazoe | |
| 5,510,565 | A | 4/1996 | Tan | |
| 7,208,079 | B2 | 4/2007 | Fakhri | |
| 7,517,435 | B2 | 4/2009 | Guth | |
| 7,572,421 | B2 | 8/2009 | Yang | |
| 7,753,992 | B2 | 7/2010 | Yang | |
| 7,968,063 | B2 | 6/2011 | Shibuya | |
| 8,480,791 | B2 | 7/2013 | Yang | |
| 2003/0075484 | A1* | 4/2003 | Sakai | C10G 29/10 208/251 R |
| 2006/0076228 | A1 | 4/2006 | Guth | |
| 2007/0278086 | A1 | 12/2007 | Vermeulen | |
| 2007/0289447 | A1 | 12/2007 | Yang | |
| 2007/0292328 | A1 | 12/2007 | Yang | |
| 2010/0000910 | A1* | 1/2010 | Gallup | C10G 31/08 208/251 R |
| 2010/0025184 | A1 | 2/2010 | Shibuya | |
| 2010/0266468 | A1 | 10/2010 | Yang | |
| 2013/0043166 | A1 | 2/2013 | Braden et al. | |
| 2013/0225897 | A1 | 8/2013 | Candelon | |
| 2013/0306521 | A1 | 11/2013 | O'Rear | |

FOREIGN PATENT DOCUMENTS

| | | |
|---|---|---|
| WO | 2012068277 | 5/2012 |

OTHER PUBLICATIONS

T. Y. Yan, Reaction of Trace Mercury in Natural Gas with Dilute Polysulfide Solutions in a Packed Column, 30 Ind. Eng. Chem. Res. 2592-2595 (1991).*

C. C Salva and D. Gallup, Mercury Removal Process is Applied to Crude Oil of Southern Argentina, SPE Latin American & Caribbean Petroleum Engineering Conference, Lima Peru (Dec. 1-3, 2010).*

International Search Report and Written Opinion for PCT/US14/54668 dated Dec. 4, 2014, 7 pages.

* cited by examiner

*Primary Examiner* — Randy Boyer

(74) *Attorney, Agent, or Firm* — Howard V. Owens

(57) ABSTRACT

Mercury in distilled products from a distillation column is removed and extracted as soluble mercury compounds with the injection of a complexing agent into the overhead sections of the column. Examples of complexing agents include polysulfides such as sodium polysulfide or ammonium polysulfide. In one embodiment, the complexing agent is injected into the inlet pipe just before the overhead condenser, converting the volatile elemental mercury into a species that is soluble in the sour water stream that collected in the overhead sections.

19 Claims, 2 Drawing Sheets

PROCESS, METHOD, AND SYSTEM FOR REMOVING HEAVY METALS FROM FLUIDS

CROSS-REFERENCE TO RELATED APPLICATIONS

This application claims benefit under 35 USC 119 of U.S. Provisional Patent Application No. 61/878,071 with a filing date of Sep. 16, 2013. This application claims priority to and benefits from the foregoing, the disclosure of which is incorporated herein by reference.

TECHNICAL FIELD

The invention relates generally to a process, method, and system for removing heavy metals such as mercury from hydrocarbon fluids such as crude oil.

BACKGROUND

In the processing of high mercury crudes, accumulation of elemental mercury may occur in the overhead sections of distillation columns of refineries, requiring special equipment handling and maintenance. Additionally, some of the mercury may accumulate in scale in the upper sections of the columns and remain in undesirable amounts in the light products such fuel gas, LPG, and light naphthas. Mercury can be removed from these light products by use of adsorbents in commercially licensed mercury removal units (MRUs). These MRUs need to be placed on several light product streams. Also, they have a limit in the amount of mercury which they can remove. If the mercury content of the light products increases to a higher value than the MRU can handle, mercury can pass through the unit. Further, MRUs are designed to remove elemental mercury by a chemical reaction with the adsorbent. If the mercury is in a particulate form of fine HgS, this is not particularly reactive with the adsorbent and mercury can pass through the unit.

As the mercury content of crude increases, there is an interest and need for improved methods and systems to control/reduce mercury levels in crudes, and preferably in the overhead sections of a crude distillation column.

SUMMARY

In one aspect, the invention relates to a method to reduce mercury content from a crude distillation unit comprising a distillation column and an overhead condenser. The process comprises: fractionally distilling a crude product containing at least 50 ppbw mercury to form overhead vapor fractions comprising light naphtha having a first concentration of mercury; contacting the overhead vapor fractions with a complexing agent to convert at least a portion of the mercury into water soluble mercury in solution, for a light naphtha product having a reduced concentration of mercury; removing the solution containing water soluble mercury from the crude distillation unit; and recovering the light naphtha product from an upper section of the distillation column.

In one embodiment, the complexing agent is injected directly into the overhead condenser. In another embodiment, the complexing agent is brought into contact with the overhead fractions in a contactor located between the distillation column and the overhead condenser.

DRAWINGS

DETAILED DESCRIPTION

Figure 1:
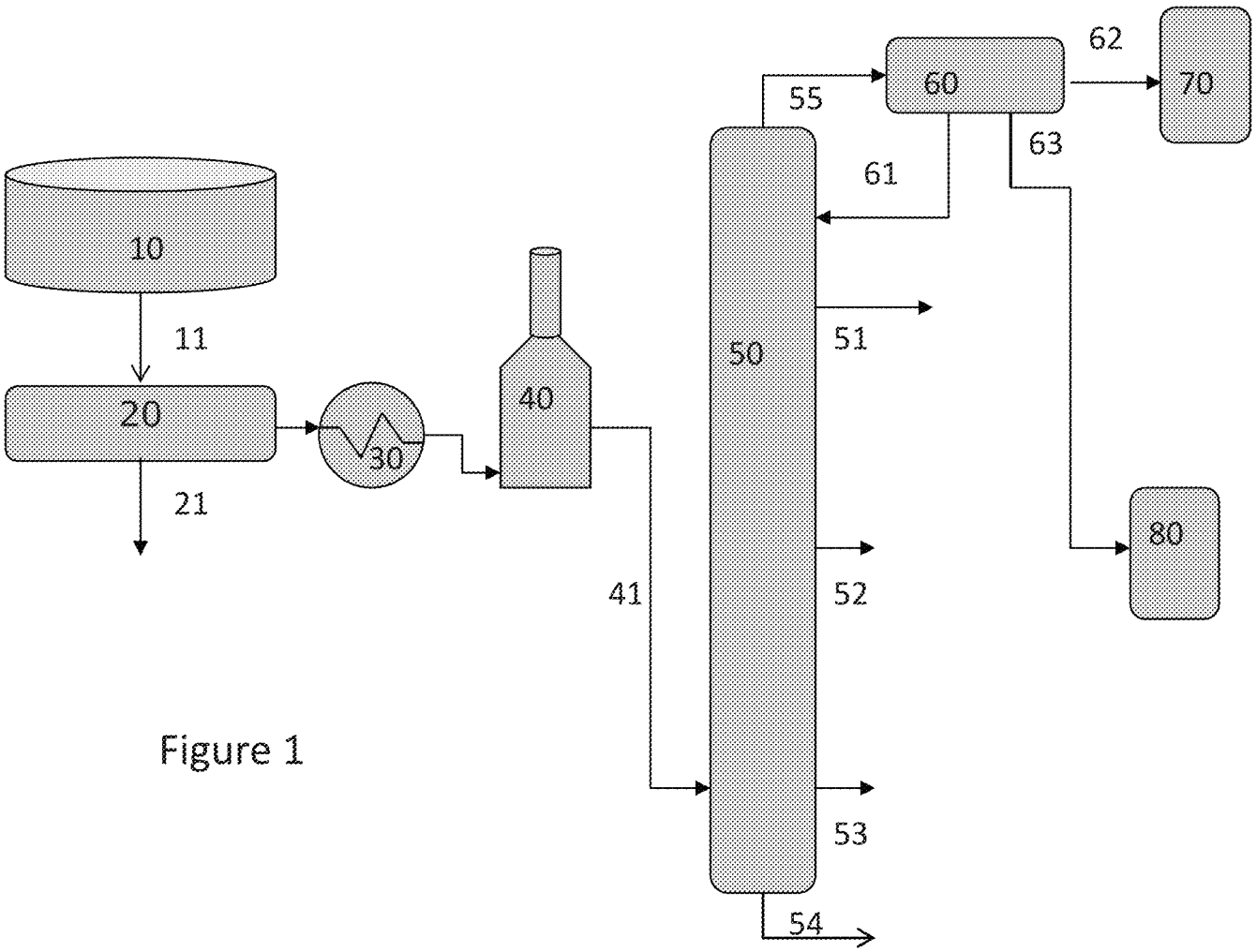
FIG. 1 is a schematic diagram illustrating the operation and distribution of mercury in typical distillation processes in petroleum refining operations.

The following terms will be used throughout the specification and will have the following meanings unless otherwise indicated.

"Crude oil" refers to a liquid hydrocarbon material. As used herein, the term crude refers to both crude oil and condensate. Crude, crude oil, crudes and crude blends are used interchangeably and each is intended to include both a single crude and blends of crudes. "Hydrocarbon material" refers to a pure compound or mixtures of compounds containing hydrogen and carbon and optionally sulfur, nitrogen, oxygen, and other elements. Examples include crude oils, synthetic crude oils, petroleum products such as gasoline, jet fuel, diesel fuel, lubricant base oil, solvents, and alcohols such as methanol and ethanol.

"High mercury crude" refers to a crude with 50 ppbw or more of mercury, e.g., 100 ppbw or more of mercury; or 250 ppbw or more of mercury.

"Trace amount" refers to the amount of mercury in the crude oil. The amount varies depending on the crude oil source and the type of heavy metal, for example, ranging from a few ppb to up to 100,000 ppb for mercury and arsenic.

"Mercury sulfide" may be used interchangeably with HgS, referring to mercurous sulfide, mercuric sulfide, and mixtures thereof. Normally, mercury sulfide is present as mercuric sulfide with an approximate stoichiometric equivalent of one mole of sulfide ion per mole of mercury ion. Mercury sulfide is not appreciably volatile, and not an example of volatile mercury. Crystalline phases include cinnabar, metacinnabar and hypercinnabar with metacinnabar being the most common.

"Volatile mercury" refers to mercury that is present in the gas phase. Volatile mercury is primarily elemental mercury ($Hg^0$) but may also include some other mercury compounds (organic and inorganic mercury species).

"Percent volatile mercury" in one embodiment is measured by stripping 15 ml of crude or condensate with 300 ml/min of nitrogen ($N_2$) for one hour. For samples which are fluid at room temperature, the stripping is carried out at room temperature. For samples which have a pour point above room temperature, but below 60° C., the stripping is done at 60° C. For samples which have a pour point above 60° C., the stripping is at 10° C. above the pour point.

"Predominantly non-volatile (mercury)" in the context of crudes refers crudes for which less than 50% of the mercury can be removed by stripping, e.g., less than 25% of the mercury can be removed by stripping; or less than 15%.

"Percent particulate mercury" refers to the portion of mercury that can be removed from the crude oil by centrifugation or filtration. After the centrifugation the sample for mercury analysis is obtained from the middle of the hydrocarbon layer. The sample is not taken from sediment, water or rag layers. The sample is not shaken or stirred after centrifugation. In one embodiment, percent particulate mercury is measured by filtration using a 0.45 micron filter or by using a modified sediment and water (BS&W) technique described in ASTM D4007-11. The sample is heated in accordance with the procedure. If the two methods are in disagreement, the modified basic BS&W test is used. The modifications to the BS&W test includes: omission of dilution with toluene; demulsifier is not added; and the sample is centrifuged two times with the water and sediments values measured after each time. If the amount of sample is small, the ASTM D4007-11 procedure can be used with smaller centrifuge tubes, but if there is disagreement in any of these methods, the modified basic BS&W test is used with the centrifuge tubes specified in ASTM D4007-11.

"Crude Distillation Unit" or CDU refers to any process unit in a refinery which distills crude oil or products derived from crude oil. It includes the main distillation unit in a refinery which processes crude oil. It also includes process units which distill products derived from crude oil, for example: fluidized bed catalytic crackers (FCC Units), cokers, and hydrocrackers. CDU may be simply referred to as "distillation column" or "distillation process." In one embodiment, the CDU is an Atmospheric Distillation Unit.

"Polysulfide" is a compound that contains sulfur-sulfur bonds. The sulfur may be present in chains or rings, and the number of sulfur atoms per molecule that are linked is >=2.

"Inorganic Polysulfide" is a compound containing polysulfide, wherein the cation which compensates for the charge of the polysulfide group is an alkali metal, alkaline earth, or combinations thereof. Examples of alkali metal polysulfides are sodium polysulfide and potassium polysulfide. An example of an alkaline earth polysulfide is calcium polysulfide.

"Organic Polysulfide" is a compound containing polysulfide wherein the cation which compensates for the charge of the polysulfide group is an alkyl group, aryl group, hydrogen, ammonium, quaternary amine, or combinations. Examples of an alkyl polysulfide are dimethydisulfide and dibutyl disulfide. An examples of an aryl polysulfide is diphenyldisulfide. Hydrogen polysulfides are also known as sulfanes.

Elemental mercury is known to cause corrosion with aluminum, brass and some other metals. Cinnabar and metacinnabar are not believed to cause corrosion problems. Most crude units limit the amount of mercury in the crude to below 500 ppbw, such as below 300 ppbw, or below 200 ppbw. This limit is achieved by blending a high mercury crude with a low mercury crude. The chemistry of mercury in crude oil and in distilled products is distinctly different. Without wishing to be bound by theory, the mercury in crude oil is predominantly particulate and predominantly non-volatile. Analysis of the mercury in crude oil indicates that the predominant form is metacinnabar particles in the size range of about 5-10 nm which are stuck to the surface of 0.1-50 micron-sized particles of quartz and other material. The quartz and other material appear to be from the formation that generated the crude oil. It is difficult to separate the micron-sized particles from crude because of their small size and the viscous nature of the crude. Separation can be done in the laboratory by use of centrifuges and filters, but these are difficult to practice on a commercial scale.

With respect to the mercury in distilled products, the mercury in these products is predominantly volatile, containing elemental mercury and very small particles of metacinnabar. The high temperatures encountered in the crude distillation furnace convert at least a portion of the metacinnabar to elemental mercury. Elemental mercury is volatile and can accumulate in the overhead sections of the distillation column and light products. A portion of the elemental mercury in the overhead sections can react with sulfur compounds to recreate very small particles of metacinnabar. The amount of mercury which reacts to recreate the metacinnabar depends on the concentration and type of the sulfur compounds, and the temperature and residence time in the overhead sections. Unlike the metacinnabar in crude, these fine particles are not attached to micron-sized formation material.

The invention relates to an improved method and a system to remove mercury in the overhead sections of distillation columns with the use of at least a complexing agent, resulting in reduced amounts of mercury in the light products. In one embodiment, the complexing agent reacts with elemental mercury, converting it to metacinnabar which is dissolved in the sour water and removed for subsequent treatment and disposal.

Hg Distribution in a Distillation Unit:

FIG. 1 is a schematic diagram illustrating the operation and distribution of mercury in typical distillation processes in petroleum refining operations. Crude oil containing particulate mercury Hg 11 from storage tank 10 flows to desalter 20, wherein suspended salts (e.g., chlorides, solids and other water-soluble compounds) and water are from crude oil and removed as stream 21. Following the desalter 20, in one embodiment the crude oil is further heated by exchanging heat with distillation products, internal recycle streams and tower bottoms liquid in exchanger 30. Finally fuel-fired furnace (fired heater) 40 is used to heat this crude oil stream, e.g., to a temperature of about 400° C., and the heated stream 41 is routed into the bottom of the distillation column 50.

In the distillation column 50 with a temperature gradient along the height of the column, the highest concentration of lower boiling, highly volatile hydrocarbons go to the top and the higher boiling, less volatile hydrocarbons are separated from the bottom. Depending on the operating conditions and the processed crude, the overhead fractions in one embodiment contains light distillate products such as light naphthas (boiling points from 86° F. and 194° F.) and gasoline (boiling point 90° F.-430° F.).

The bottom of a distillation column is continuously heated with a reboiler (not shown). The overhead fractions stream 55 is cooled with overhead condenser 60 and with reflux stream 61 returning to the upper portion of the column, causing a temperature drop along the height of the column. At every stage (tray) of the columns, the hydrocarbons approach vapor-liquid equilibrium, allowing the lighter hydrocarbon gases to escape to top while the heavier hydrocarbons trickle down to column bottom, resulting in higher concentrations of specific groups of hydrocarbons at different stages of the distillation column that can be drawn off, e.g., naphtha 51, distillates 52, atmospheric gas oil AGO 53, atmospheric residue 54.

During the high temperature distillation, the particulate Hg converts to elemental mercury, which goes out with the overhead fractions, e.g., having boiling points of about 250° F. to 400° F., through line 55 and condenser 60. Most of the mercury ends up in the fuel gas out of the condenser 60, which is subsequently removed in a mercury removal unit (MRU). However, some of the mercury is recycled to the column by way of reflux 61, and ends up in the naphtha products 51, subsequently requiring mercury removal in a mercury removal unit (MRU). A small amount of steam is typically injected into the column to assist in the distillation (not shown). This steam condenses in the overhead section and is withdrawn as sour water ("sour" because of dissolved hydrogen sulfide) for subsequent treatment in MRU 80. Some of the mercury will end up in the sour water 63 and it is assumed to be metacinnabar which is dissolved in the sour water. Both cinnabar and metacinnabar are soluble in sulfidic aqueous solutions, especially when they are caustic.

Mercury Removal in Distillation Unit:

In one embodiment, a complexing agent is added to the overhead fractions from a distillation column to reduce the amount of mercury which is present. The complexing agent reacts with elemental mercury and converts it to metacinnabar which is dissolved in the sour water.

The complexing agent can be injected at any convenient location where it will contact the gas and other products in the overheads from the column. In one embodiment, the injection is a single point injection into the inlet pipe just before the overhead condenser. In another embodiment, the injection is a single injection into the overhead vapor line near the top of the column. In yet another embodiment, the injection can be a multi-point injection in parallel into the vapor line from the top of the column to the overhead condenser. The complexing agent extracts and transfers the mercury to the sour water, where it will be present as dissolved mercury anions, presumably $HgS_2^{2-}$ or $HgS_2H^-$. This anionic mercury can be removed by adsorption, or by complexation with biological organisms in refinery waste treatment plants and precipitation (with or without filtration) . Alternatively, the mercury-containing sour water stream can be disposed by injection into an underground formation.

In another embodiment, a least a portion of the complexing agent is injected or added to the reflux stream from the condenser to the column. In yet another embodiment, a complexing agent in solution is injected (fed) into a contactor positioned between the column and the condenser for the removal of mercury before entering the condenser. The contactor is preferably a countercurrent contactor. The washed lighter products (e.g., naphtha) are then injected into the overhead condenser inlet. The solution containing extracted mercury is routed to a MRU for removal, or for disposal.

Complexing Agent:

"Complexing agent" refers to a material or compound that is capable of extracting mercury from the overhead fractions, e.g., removing elemental mercury and converting it to metacinnabar which is dissolved in the sour water into the liquid phase as soluble mercury sulfur compounds (e.g. $HgS_2^{2-}$).

In one embodiment, the complexing agent is selected from inorganic and organic polysulfides, e.g., sodium polysulfide, calcium polysulfide, ammonium polysulfide, di-tert-butyl polysulfide (TBPS), and amine polysulfide. In another embodiment, the complexing agent is selected from sodium thiocarbamate, sodium dithiocarbamate, ammonium thiocarbamate, ammonium dithiocarbamate, and mixtures thereof.

The amount of complexing agents to be added to the overhead fractions of the distillation column is determined by the effectiveness of complexing agent employed. The amount is at least equal to the amount of mercury in the crude on a molar basis (1:1), if not in an excess amount. In one embodiment, the molar ratio ranges from 5:1 to 10,000:1. In another embodiment, from 10:1 to 5000:1. In yet another embodiment, a molar ratio of sulfur additive to mercury ranging from 50:1 to 2500:1. In one embodiment with the use of a polysulfide compound as a complexing agent, the amount is sufficient for a sulfur to mercury stoichiometric ratio ranging from 1 to 100,000; from 10 to 10,000; and from 50 to 5.000. The ratio is calculated based on the rate and mercury concentration in the crude and the sulfur concentration in the polysulfide.

The complexing agent reduces the concentration of mercury in at least one of the light products for at least 10% in one embodiment, at least 25% in a second embodiment, at least 50% in a third embodiment, and at least 75% in a fourth embodiment. The mercury removal from the light products results in an increase in mercury concentration in the sour water of at least 10% in one embodiment; at least 25% in a second embodiment; and at least 50% in a third embodiment. This percentage is calculated based on the rates and mercury concentrations of the crude and sour water. A light product such as light naphtha after treatment by injection of complexing agent has a mercury concentration of less than 10 ppbw in one embodiment; less than 5 ppbw in a second embodiment; less than 2 ppbw in a third embodiment; and less than 1 ppbw in a fourth embodiment.

In one embodiment, the complexing agent is an inorganic polysulfide such as sodium polysulfide, for an extraction of mercury into the sour water according to equation: $Hg(g)+Na_2S_x(aq)+H_2O \rightarrow HgS_2H^-(aq)+Na_2S_{x-2}(aq)+OH^-(aq)$, where (g) denotes the mercury in the gas phase, and (aq) denotes a species in water.

Optional Additives:

In one embodiment in addition to the complexing agent, at least one of an anti-foam and/or a demulsifier is added to the overhead fractions. As used herein, the term anti-foam includes both anti-foam and defoamer materials, for preventing foam from happening and/or reducing the extent of foaming Additionally, some anti-foam material may have both functions, e.g., reducing/mitigating foaming under certain conditions, and preventing foam from happening under other operating conditions. Anti-foam agents can be selected from a wide range of commercially available products such as silicones, e.g., polydimethyl siloxane (PDMS), polydiphenyl siloxane, fluorinated siloxane, etc., in an amount of 1 to 500 ppm.

In one embodiment, at least a demulsifier is added in a concentration from 1 to 5,000 ppm. In another embodiment, a demulsifier is added at a concentration from 10 to 500 ppm. In one embodiment, the demulsifier is a commercially available demulsifier selected from polyamines, polyamidoamines, polyimines, condensates of o-toluidine and formaldehyde, quaternary ammonium compounds and ionic surfactants. In another embodiment, the demulsifier is selected from the group of polyoxyethylene alkyl phenols, their sulphonates and sodium sulphonates thereof. In another embodiment, the demulsifier is a polynuclear, aromatic sulfonic acid additive.

In one embodiment, a sufficient amount of an ammonium hydroxide or an amine is injected into the crude unit overhead fractions to maintain the pH level of at least 7 to prevent and/or minimize the precipitation of HgS particles. In another embodiment, the pH is maintained at >8. Precipitation of HgS particles can accumulate in the naphthas, leading to filter plugging in downstream equipment. In another embodiment, controlling the pH prevents premature decomposition of polysulfides.

Figure 2:
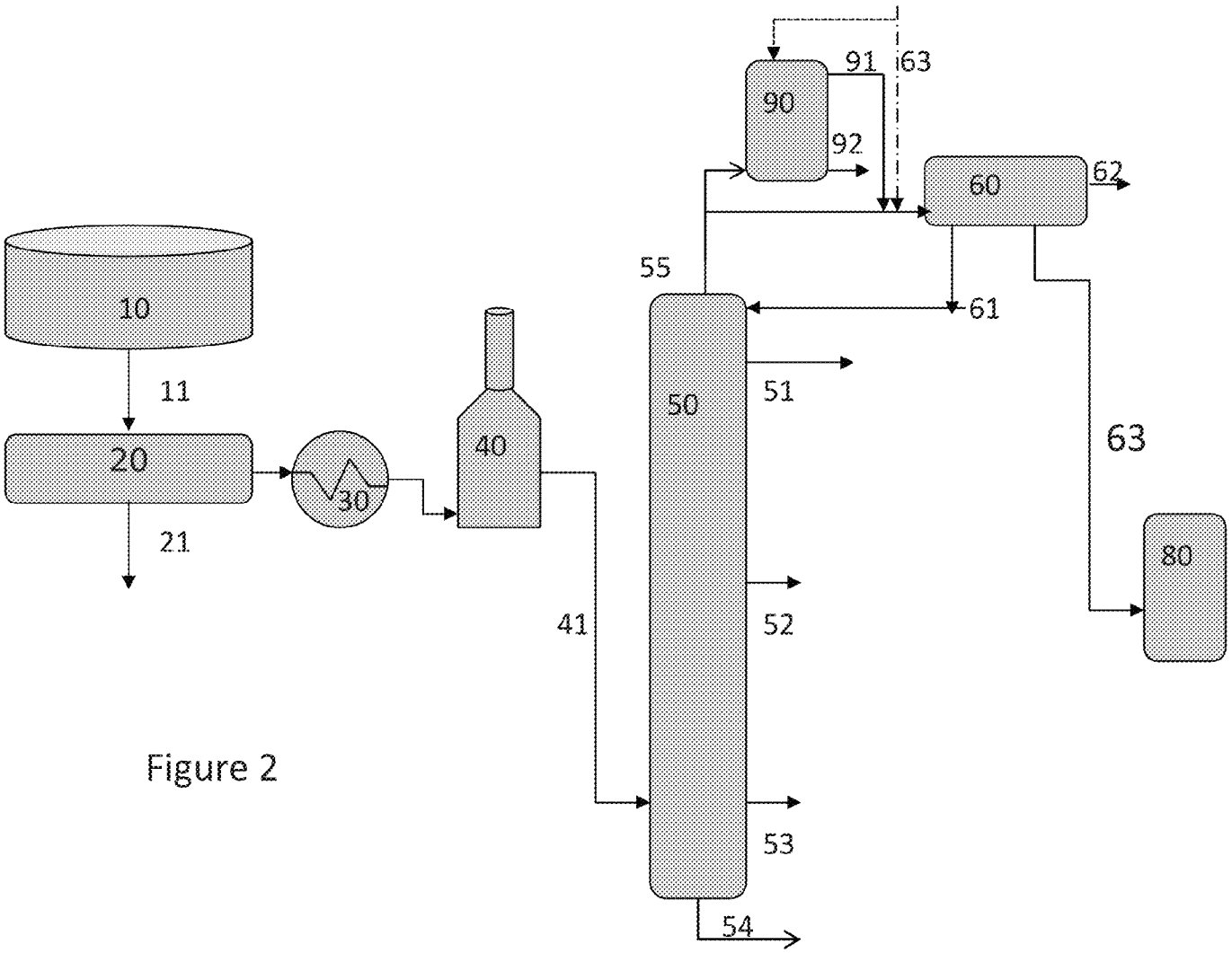
FIG. 2 is a diagram schematically illustrating embodiments of a system and process for removing mercury from the distillation column of FIG. 1.

FIG. 2 of a diagram schematically illustrating embodiments of a system and process for removing mercury from the distillation column of FIG. 1. In one embodiment, a complexing agent 63 such as ammonium sulfide is added to the inlet pipe just before the overhead condenser 60 (as dashed line). In another embodiment, the complexing agent 63 is added to the contactor 90 (as dotted line) for the removal of mercury from the overhead fractions stream before it is directed to the cooling condenser 60 as treated overhead stream 91. Stream 92 containing extracted mercury is routed to a MRU for removal, or for disposal. In the system as compared to FIG. 1, most of the mercury is shifted from the fuel gas stream 62 to the sour water stream 63, alleviating the need for MRU 70 and individual MRUs to treat the product streams such as the naphtha stream 51.

EXAMPLES

The following illustrative examples are intended to be non-limiting.

Example 1

In a three-neck flask with a Teflon stirrer (as glass reactor) was placed a 200 ml of solution of stannous chloride and sulfuric acid, for a concentration of 10% stannous chloride and 5% sulfuric acid. When mercury vapors were to be generated, 0.5 cc of a 209.8 ppm Hg solution of mercuric chloride in water was injected into the reactor via a septum. The stannous chloride rapidly reduced the mercury to elemental mercury. In the glass reactor was a line carrying 300 cc/min of nitrogen which bubbled in the reducing acidic stannous chloride solution. This was used to sweep the evolved elemental mercury to the downstream absorbers.

The glass reactor was connected to two absorbers in series, each of which contained 200 ml of solution. The absorbers were equipped with a glass frit to produce small bubbles. The bubbles contacted the absorbing solution for about one second. The first absorber contained the test solution. The second contained 3% sodium polysulfide in water. The 3% sodium polysulfide solution was prepared by dilution of a 30% solution of sodium polysulfide. This second absorber was a scrubber to remove the last traces of mercury from the nitrogen to provide mercury mass closures. Analysis of the exit gas from the second absorber by both Lumex and Jerome techniques found no detectable mercury.

Samples of the liquids in the reactor and two absorbers and gas leaving the reactor and leaving the two absorbers were drawn at periodic intervals over a ninety-minute period and analyzed for mercury by Lumex. Mercury balances over 57 runs average 98.6%. The reaction of the mercury chloride in the three neck flask is rapid, and the elemental mercury was stripped rapidly as well. After a typical ninety-minute period the conversion and displacement of mercury in the reactor averaged 94%.

The efficiency of the test solutions was calculated by comparing the amount of mercury taken up in the first reactor absorber to the amount taken up in both absorbers. If no mercury was taken up in the first reactor with the test solution, the efficiency was zero percent. If all the mercury was taken up in the first reactor, the efficiency was 100%. At the end of the experiments no evidence of precipitated HgS was observed in the absorbers. The solutions were clear.

Examples 2-5

The experiments were to evaluate the Hg uptake in various solutions. Deionized water (DI) was used in the first absorber to determine if elemental mercury could be captured by water alone. In examples 2-4, sodium polysulfide was added in varying amounts to the deionized water. Sodium polysulfide is effective in capturing elemental mercury vapors at 1 second of contact even when the sulfur to mercury stoichiometric ratio is near 2. No detectable amount of mercury was absorbed and retained in water in the absence of sodium polysulfide.

TABLE 1

| Example | Solvent | ppm $Na_2S_x$ | S/Hg Molar ratio | Efficiency % |
|---|---|---|---|---|
| 2 | DI Water | 0 | 0 | 0 |
| 3 | DI Water | 303 | 3,592 | 25.81 |
| 4 | DI Water | 758 | 8,979 | 33.76 |
| 5 | DI Water | 3,032 | 35,916 | 60.31 |

Example 6-9

The apparatus in Example 1 was modified and replaced by a simple reaction in which crude oil was heated to 140° C. while being stripped with 300 cc/min of nitrogen. The elemental mercury which evolved from the crude was passed to a 200 ml bubbler filled with 3% sodium polysulfide in water. There was no second adsorber. Four different crude oil samples from various locations were evaluated. The percentage of initial mercury remaining in the crude and the percentage captured by the polysulfide solution (NPS) were measured. Results in Table 3, show that sodium polysulfide is effective in capturing elemental mercury as it evolves from crude oil. Analysis of the mercury content of the gas entering and leaving the absorber showed the presence of mercury entering the absorber but no mercury could be detected leaving the absorber. The polysulfide solutions remained clear and showed no indication of the formation of precipitated HgS. The mercury balances did not add up to 100% presumably because of mercury adsorption on the walls of the system ahead of the absorber.

TABLE 3

| | Example | | | | | | | |
|---|---|---|---|---|---|---|---|---|
| | Example 6 | | Example 7 | | Example 8 | | Example 9 | |
| time, min | % in Crude | % in NPS | % in Crude | % in NPS | % in Crude | % in NPS | % in Crude | % in NPS |
| 0 | 100 | 0 | 100.0 | 0.0 | 100.0 | 0.0 | 100.0 | 0.0 |
| 30 | 84.4 | 5.7 | | | | | 78.6 | 3.0 |
| 40 | 75.6 | 7.8 | 80.1 | −8.5 | 85.9 | 6.7 | | |
| 50 | 69.8 | 7.7 | 82.1 | 5.4 | 75.7 | 3.0 | 90.2 | 3.0 |
| 60 | 60.3 | 15.6 | 68.6 | 19.9 | 78.3 | 5.2 | 73.7 | 4.0 |
| 70 | 49.0 | 23.3 | 65.5 | 24.0 | 81.8 | 4.4 | 71.6 | 7.2 |
| 80 | 50.0 | 27.4 | 67.8 | 22.8 | 71.6 | 6.7 | 71.7 | 12.1 |
| 90 | 52.7 | 27.5 | 65.1 | 28.7 | 75.4 | 9.5 | 67.0 | 6.2 |
| 120 | — | — | — | — | — | — | 69.1 | 4.8 |
| 210 | — | — | — | — | — | — | 54.1 | 12.8 |

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

As used herein, the term "include" and its grammatical variants are intended to be non-limiting, such that recitation of items in a list is not to the exclusion of other like items that can be substituted or added to the listed items. The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms, including technical and scientific terms used in the description, have the same meaning as commonly understood by one of ordinary skill in the art to which this invention belongs.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A process for reducing mercury content from a crude distillation unit comprising a distillation column and an overhead condenser, the process comprising:

fractionally distilling a crude product containing at least 50 ppbw mercury to form overhead vapor fractions comprising light naphtha having a first concentration of mercury;

adding a sufficient amount of at least one of an ammonium hydroxide and an amine to the overhead fractions for a pH level of at least 7;

contacting the overhead vapor fractions with a complexing agent to convert at least a portion of the mercury into water soluble mercury in solution, for a light naphtha product having a reduced concentration of mercury; and removing the solution containing water soluble mercury from the crude distillation unit; recovering the light naphtha product from an upper section of the distillation column.

2. The process according to claim 1 wherein the complexing agent is selected from inorganic polysulfides and organic polysulfides.

3. The process according to claim 2, wherein the complexing agent is selected from sodium polysulfide and ammonium polysulfide.

4. The process according to claim 2, wherein the overhead vapor fractions is brought into contact with a complexing agent at a sulfur-to-mercury stoichiometric ratio of from 1 to 100,000.

5. The process according to claim 4, wherein the overhead vapor fractions is brought into contact with a complexing agent at a sulfur-to-mercury stoichiometric ratio is from 10 to 10.000.

6. The process according to claim 5, wherein the overhead vapor fractions is brought into contact with a complexing agent at a sulfur-to-mercury ratio is from 50 to 5,000.

7. The process according to claim 1, wherein the overhead vapor fractions is brought into contact with the complexing agent by injecting the complexing agent into an inlet pipe before the overhead condenser.

8. The process according to claim 1, wherein the overhead vapor fractions is brought into contact with the complexing agent by injecting the complexing agent into any of: directly into the overhead condenser; an overhead vapor line near the distillation column.

9. The process of claim 1, wherein the overhead vapor fractions is brought into contact with the complexing agent in a contactor located in between the distillation column and the overhead condenser.

10. The process of claim 1, wherein the reduced concentration of mercury in the light naphtha product is less than 10 ppbw.

11. The process of claim 1, wherein the reduced concentration of mercury in the light naphtha product is at least 10% less than the first concentration of mercury.

12. The process of claim 11, wherein the reduced concentration of mercury in the light naphtha product is at least 25% less than the first concentration of mercury.

13. The process of claim 12, wherein the reduced concentration of mercury in the light naphtha product is at least 50% less than the first concentration of mercury.

14. The process of claim 1, wherein the complexing agent is injected into at least one of: a) an inlet pipe before the overhead condenser; and b) directly into the overhead condenser, for the solution containing water soluble mercury to be withdrawn as a sour water stream containing at least 10% of the mercury in the crude product.

15. The process of claim 14, wherein sour water stream contains at least 25% of the mercury in the crude product.

16. The process of claim 15, wherein the sour stream contains at least 50% of the mercury in the crude product.

17. The process of claim 14, further comprising removing mercury from the sour water by at least one of adsorption, complexation with biological organisms, precipitation and combinations thereof.

18. The process of claim 1, wherein the mercury in the crude product is predominantly non-volatile.

19. The process of claim 1, wherein the mercury in the crude product is particulate.

* * * * *